United States Patent [19]

Johnson

[11] 4,435,026

[45] Mar. 6, 1984

[54] MODULAR STACKING TRAYS

[76] Inventor: Michael R. Johnson, 2725 Foxfire Ct., Clearwater, Fla. 33519

[21] Appl. No.: 385,694

[22] Filed: Jun. 7, 1982

[51] Int. Cl.[3] ..... A47F 1/00; A47F 1/14; A47F 1/12

[52] U.S. Cl. ..... 312/45; 312/72; 312/35; 312/42; 312/111; 211/49 D; 206/511

[58] Field of Search ..... 312/45, 72, 42, 73, 312/108, 111, 257 SM, 257 A; 211/49 D; 206/509, 511; 108/111

[56] References Cited

U.S. PATENT DOCUMENTS

| | | | |
|---|---|---|---|
| 1,584,234 | 5/1926 | Lewis | 312/73 |
| 2,443,871 | 6/1948 | Shield | 211/49 D |
| 2,765,209 | 10/1956 | Backus | 312/350 |
| 2,818,978 | 1/1958 | Post | 312/45 |
| 2,915,162 | 12/1959 | Umstead | 312/45 |
| 3,055,293 | 9/1962 | Lariccia | 312/45 |
| 3,477,774 | 11/1969 | Atwood | 312/45 |
| 3,521,764 | 7/1970 | Loomis | 206/509 |
| 3,606,022 | 9/1971 | Beesley, Jr. | 211/49 D |
| 3,784,022 | 1/1974 | Beesley, Jr. | 312/45 |
| 4,228,903 | 10/1980 | Eckert | 211/49 D |

*Primary Examiner*—James T. McCall
*Assistant Examiner*—Thomas A. Rendos
*Attorney, Agent, or Firm*—Ronald E. Smith

[57] ABSTRACT

A gravity fed dispensing device of the type designed to serially dispense a plurality of cylindraceous containers. The containers to be dispensed are charged into the device at the top thereof, and follow a series of downwardly descending ramp means to the discharge station. Each successive ramp means segment is sloped in a direction opposite to the direction of slope of the ramp means segment that precedes and succeeds it. The ramp means are disposed in interconnecting relation to transversely spaced sidewall members, and a tray member is defined by one set of sidewalls interconnected by a pair of such ramp means segments, adjacent the upper and lower edges thereof. The tray members are stackable to increase the storage capacity of the device as desired, and the ramp means segments are specifically positioned so that the upright and overturned positions of the tray members are identical.

4 Claims, 2 Drawing Figures

MODULAR STACKING TRAYS

BACKGROUND OF THE INVENTION

1. Field of the Invention

This invention relates generally to gravity fed dispensing devices, and more specifically relates to a modular, stackable device formed by a plurality of interchangeable tray members.

2. Description of the prior art.

The following United States patents show dispensing devices in the general field of this invention:

| Patentee | U.S. Pat. No. | Date of Issue |
|---|---|---|
| Michel | 1,379,035 | 05/24/21 |
| Kleinwachter | 2,230,460 | 02/04/41 |
| Huckfeldt | 2,267,921 | 12/30/41 |
| Gauvreau | 2,269,761 | 01/13/42 |
| Cretors | 3,134,510 | 05/26/64 |
| Gandara | 4,109,984 | 08/29/78 |

There is a need for a dispensing device that is made of modular components. The components should be interchangeable with one another so that the user of the device need not be concerned with any specific assembly procedures. The components should be interlocking and stackable so that the device could have a variable storage capacity. The components should be able to form the desired device whether in their respective upright or inverted positions, i.e., the upright and inverted positions of the components should provide the same component.

The needed device should be of simple, elegant construction, and thus economical to manufacture.

The devices that have been disclosed heretofore do not fill the needs that have been identified.

SUMMARY OF THE INVENTION

The longstanding but heretofore unfulfilled need for a modular dispensing device is now provided in the form of a plurality of substantially identical tray members that collectively define a downwardly sloping, discontinuous ramp means when stacked one upon the other. Each tray member has a transversely opposed pair of parallel sidewall members that are interconnected by a pair of upper and lower ramp means segments. Each segment commences at one end of its associated sidewalls, and extends in the direction of the longitudinally spaced opposing end of such sidewalls but terminates before reaching such opposing end. The gap between the end of each ramp segment and the end of its sidewalls is slightly greater than the outside diameter of the cylindraceous container to be dispensed by the device, whether such containers be beverage cans, tubes of lipstick, or the like.

When a container drops off the end of a ramp segment, it lands on a lower ramp segment that extends from the sidewall toward which the next higher segment extended but did not reach. The lower segment also extends toward but does not reach the longitudinally spaced end of its associated sidewalls, and also fails to complete the extension by a similar gap. Accordingly, as the cylindraceous item follows its downwardly sloping path through the dispenser, it reverses its direction of travel every time it drops from a higher ramp segment to the next lower segment.

It is therefore seen that it is an important object of this invention to provide modular stacking trays so that the user of the invention can build a dispensing device having a storage capacity that is preselected by such user.

Another object is to provide a compact dispensing device that utilizes a minimum amount of storage space while storing a maximum amount of items to be dispensed.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
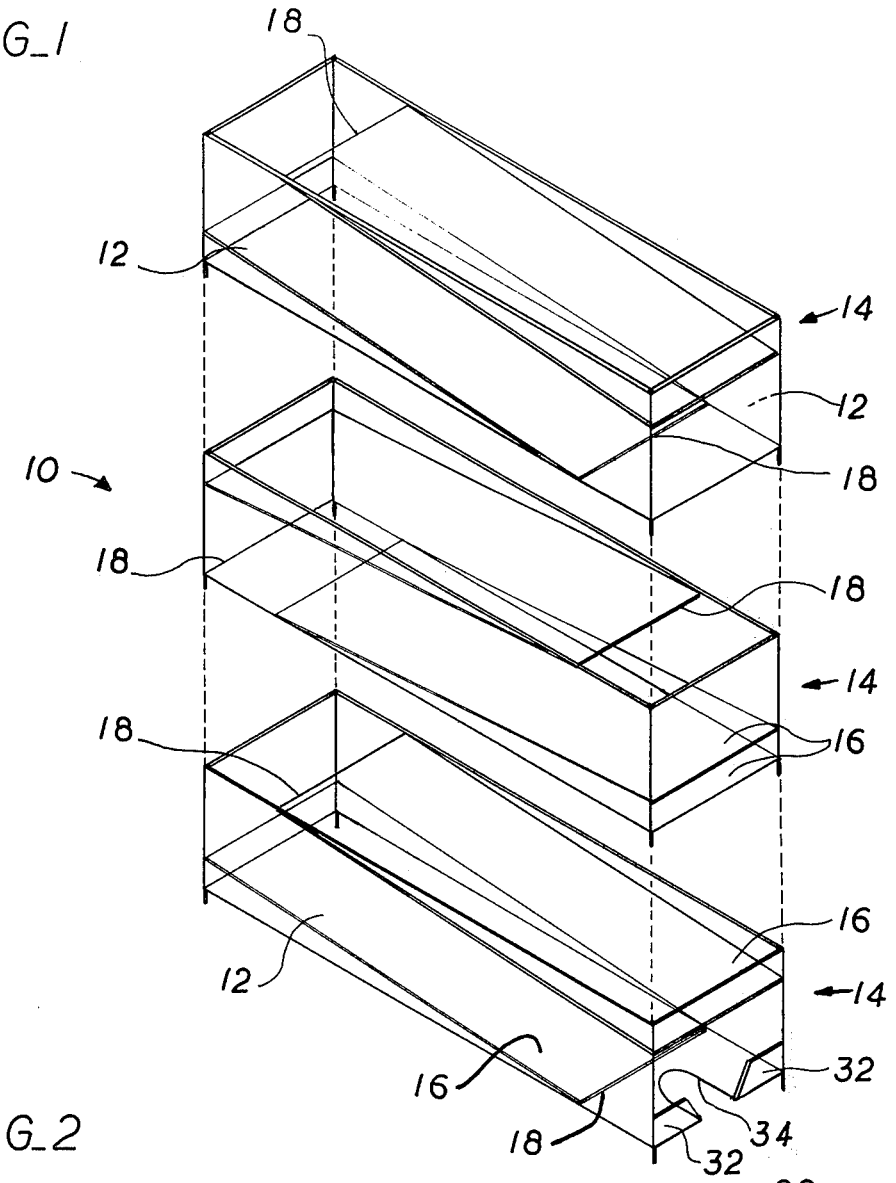
FIG. 1 is an exploded perspective view of the perferred embodiment of the invention.

Referring now to FIG. 1, there it will be seen that an embodiment of the invention that is illustrative thereof is designated 10 as a whole.

The reference numeral 12 designates the upstanding (vertically disposed), longitudinally aligned, transversely and oppsingly spaced, parallel, rectangular in configuration, planar sidewall members that define the individual tray members 14 that collectively form the dispensing device 10 when stacked one upon the other.

Each oppositely disposed pair of sidewall members 12 is interconnected by oppositely sloped ramp segments, collectively designated 16. Each ramp segment 16 extends from an opposite end of its associated sidewall 12 relative to its same-tray 14 contiguous segments, as is clearly shown. Since each ramp segment 16 is truncated as at 18, it should be clear that a can or other cylindraceous container 20 (FIG. 2) will roll, when placed on its side, under the influence of gravity, from the uppermost ramp segment to the lowermost. Each item 20 being dispensed will fall freely from the next highest ramp segment 16 to the next lowest segment 16. The fall can be cushioned by the addition of a shock absorbing material (not shown) at the highest portion of each ramp segment 16.

Figure 2:
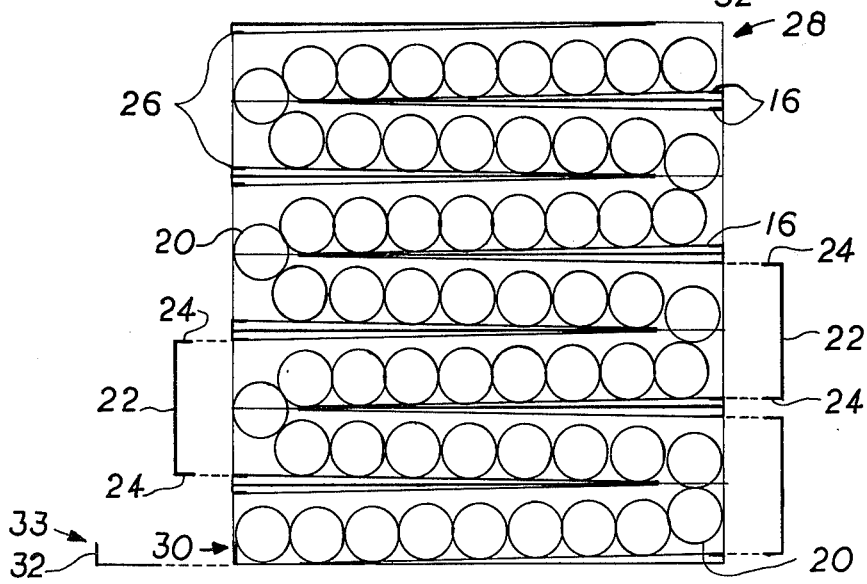
FIG. 2 is a longitudinal cross sectional view of the preferred embodiment of the invention.

When the trays 14 are stacked as depicted in FIG. 2, the truncated ends 18 of each ramp segment 16 will abut the truncated end 18 of a ramp segment 16 associated with the next contiguous tray member 14. The respective truncated ends 18 will lie on a horizontal plane defined by the longitudinally aligned edges of the tray members 14. It should be observed that the trays can be stacked as shown or inverted and stacked, there being no difference between an "upright" tray 14 and an "inverted" tray 14.

Releasably attachable planar end plate members 22 (FIG. 2) are provided to close the open ends of the trays 14 to prevent unwanted discharge of the items 20 being dispensed. Although numerous ways exist to releasably secure each end plate 22 to cap the respective open ends of the trays 14, the end plates 22 are shown, for purposes of illustration, as having peg members 24 that are releasably but snugly received by complementally formed peg-receiving bores 26 provided in the outward edges of the sidewalls 12. The end plates 22 are of sufficient height dimension to cap the open end of two (2) contiguous trays 14. The end plates 22 are vertically staggered as shown so that the uppermost and lowermost tray members 28 and 30, respectively, remain open ended. This allows the items 20 to be charged and discharged into the device 10. It will be observed that the loading and unloading of the items 20 occurs at longitudinally opposite ends of the device 10.

The lowermost tray 30 has a bifurcated weir member 32 to prevent the exiting of the lead item 20 from the device 10 in the absence of human intervention. A thumb-receiving dished portion 34 is formed in the floor portion, as shown, of a detachable discharge piece, designated 33 as a whole. The discharge piece 33 is shown attached to the lowermost tray member 30 in FIG. 1, and is shown in its detached position in FIG. 2. It is preferably detachably secured into position by pegs 24 and peg-receiving bores 26, not shown, of the type employed in securing the end plates 22 into position. The provision of discharge piece 33 allows all of the tray members to be manufactured alike. Thus, any tray member 14, when provided with discharge piece 33, can be used as the lowermost tray 30.

The sidewalls 12 will be spaced apart so as to accommodate the length of the item 20 being stored and ultimately dispensed, of course. Thus, if Life Savers (TM) are being stored and dispensed, the sidewalls 12 will be narrowly spaced vis a vis their spacing if beer cans are being stored and dispensed. The transverse spacing should be such as to guide the item 20 being dispensed so that the item cannot pivot significantly about its axis of roll.

Registration pins 36 depend from the corners of each tray 14, as is clearly shown in FIG. 1. Complementally formed peg-receiving bores are formed in the vertically spaced, opposite corners of each tray so that the trays will interlock when stacked. Although FIG. 1 shows depending registration pins 36, it should be understood that the term "depend" includes a meaning of upward projection as well, since, as aforesaid, the trays 14 can be used in their "upright" position as shown in FIG. 1, or in an inverted position as shown when FIG. 1 is inverted. (When inverted, of course, discharge piece 33 would be re-positioned). In use, the inventive device 10 could be used in the position shown in FIG. 1 so that the lowermost registration pins could serve as legs for the assembly, thereby perhaps easing the grasping of the dispensed items from the discharge station 33.

Clearly, any number of trays 14 can be stacked one upon the other. Where the items 20 are to be refrigerated, the top loading feature of the device 10 permits the coolest items, i.e., the items that have been stored in the device 10 for the longest period of time, to be discharged. The device 10 can be used in domestic refrigerators, and the consumer may stack as many trays 14 as space will permit or may use as little as one tray 14 if a relatively small storage capacity is desired. In commercial applications, the device 10 can be stored in refrigerated compartments or may be used on unrefrigerated counter tops for display and dispensing purposes. The sidewalls 12 could be made of transparent, translucent, or opaque materials if desired. (A transparent device is depicted in the drawings). Furthermore, the ramp segments 16 could be pivotally mounted so that the slope of each segment could be adjusted as desired. Moreover, to save materials, the ramp segments could simply be provided in the form of cooperatively positioned ledge members. Curved surfaces could also be added to break the fall of each item 20 as it drops from the next highest ramp segment 16. In view of the foregoing disclosure, one skilled in the art of machine designing could develop a number of variations on the inventive concept without departing from the teachings of this disclosure.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A dispensing device, comprising, a plurality of tray members having a common configuration and dimenstion so as to be interchangeable with one another, said tray members having a pair of substantially parallel, transversely spaced, upstanding, sidewalls, a first and second ramp means disposed in interconnecting relation to said sidewalls, said first and second ramp means having a common length, said common length equal to the length of said sidewalls less a length slightly greater than the outside diametr of a beverage can to be dispensed by said device, said first and second ramp means extending from opposite ends of said sidewalls, said tray members being open-ended, a plurality of detachably secured end plate members for capping the open ends of said tray members, each of said end plate members of sufficient dimension to cap a pair of vertically adjacent open ends of said tray members when said tray members are stacked one atop the other, opposing ones of said end plate members being disposed in overlapping relation relative to one another so that opposite ends of the uppermost and lowermost tray members are disposed in open communication to the space around said device so that items to be dispensed are loaded into the uppermost one of said plurality of tray members and unloaded from the lowermost one of said plurality of tray members, said charging and discharging accomplished at longitudinally opposite ends of said device.

2. The device of claim 1, wherein each of said tray members is provided with registration pins and cooperatively positioned registration pin-receiving bores at preselected points on the top or bottom edges of said sidewalls, so that consecutive ones of said trays can be stacked by mating said pins and bores.

3. The device of claim 2, wherein a discharge member is detachably secured to the lowermost one of the stacked trays at the free end of the lowermost ramp segment, said discharge member serving to collect items that have rolled down the preceding ramp segments.

4. The device of claim 3, wherein said discharge member includes a flat floor portion, an upstanding weir portion at the end thereof, and a dished portion formed in said floor portion so that said floor portion supports items discharged by the lowermost of said ramp segments, said weir portion acts as a stop to prevent said rollable items from exiting said device, and said dished portion provides an opening to facilitate gripping of the dispensed item by a human hand.

* * * * *